US010865512B2

(12) United States Patent
Lee et al.

(10) Patent No.: US 10,865,512 B2
(45) Date of Patent: Dec. 15, 2020

(54) LAUNDRY TREATING APPARATUS

(71) Applicant: LG Electronics Inc., Seoul (KR)

(72) Inventors: Jongsung Lee, Seoul (KR); Youngbae Park, Seoul (KR); Soobong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 235 days.

(21) Appl. No.: 15/901,134

(22) Filed: Feb. 21, 2018

(65) Prior Publication Data

US 2018/0237979 A1 Aug. 23, 2018

(30) Foreign Application Priority Data

Feb. 21, 2017 (KR) ..... 10-2017-0022800

(51) Int. Cl.

| | |
|---|---|
| ***D06F 39/14*** | (2006.01) |
| ***D06F 37/28*** | (2006.01) |
| ***D06F 37/42*** | (2006.01) |
| *D06F 105/44* | (2020.01) |
| *D06F 103/40* | (2020.01) |

(52) U.S. Cl.

CPC ..... *D06F 39/14* (2013.01); *D06F 37/28* (2013.01); *D06F 37/42* (2013.01); *D06F 2103/40* (2020.02); *D06F 2105/44* (2020.02); *E05Y 2900/312* (2013.01)

(58) Field of Classification Search

CPC ..... D06F 37/28; D06F 37/42; D06F 39/14; D06F 2224/00; D06F 2103/40; D06F 2105/44; E05Y 2900/312

See application file for complete search history.

(56) References Cited

U.S. PATENT DOCUMENTS

| | | | | |
|---|---|---|---|---|
| 3,991,520 | A * | 11/1976 | Graham | D06F 58/04 49/276 |
| 7,997,105 | B2 * | 8/2011 | Hill | D06F 39/14 68/196 |
| 2004/0177656 | A1 | 9/2004 | Kwon | |
| 2005/0044898 | A1 | 3/2005 | Park et al. | |
| 2006/0006661 | A1 * | 1/2006 | Kim | D06F 39/14 292/29 |

(Continued)

FOREIGN PATENT DOCUMENTS

| | | |
|---|---|---|
| EP | 2147996 | 1/2010 |

OTHER PUBLICATIONS

Extended European Search Report in European Application No. 18157360.1, dated Jul. 25, 2018, 9 pages.

*Primary Examiner* — Joseph L. Perrin
(74) *Attorney, Agent, or Firm* — Fish & Richardson P.C.

(57) ABSTRACT

There is disclosed a laundry treating apparatus comprising a cabinet having an opening; a laundry accommodating portion mounted in the cabinet and comprising an opening aperture which is communicable with the opening; a door rotatably coupled to the cabinet and provided to open and close the opening; a locking portion detachably coupled to the door; and a coupling portion provided in the cabinet to be repeatedly coupled to or decoupled from the locking portion whenever an external force is applied to the door, wherein the door comprises a first frame provided to open and close the opening; and a second frame coupled to one surface of the first frame, and the locking portion is provided in the first frame and prevented from contacting with the second frame.

20 Claims, 8 Drawing Sheets

(56) References Cited

U.S. PATENT DOCUMENTS

| | | | | |
|---|---|---|---|---|
| 2007/0256459 | A1* | 11/2007 | Yoon | D06F 37/28 68/139 |
| 2009/0251032 | A1* | 10/2009 | Jeon | D06F 37/42 312/220 |
| 2010/0115848 | A1* | 5/2010 | Lee | D06F 39/14 49/394 |
| 2016/0230330 | A1* | 8/2016 | Lee | D06F 58/20 |
| 2017/0342621 | A1* | 11/2017 | Chun | D06F 39/14 |

* cited by examiner

LAUNDRY TREATING APPARATUS

CROSS-REFERENCE TO RELATED APPLICATIONS

This application claims priority to Korean Patent Application No. 10-2017-0022800, filed on Feb. 21, 2017 in Korea, the entire contents of which is hereby incorporated by reference in its entirety.

BACKGROUND OF THE DISCLOSURE

Field of the Disclosure

Embodiments of the present disclosure relate to a laundry treating apparatus.

Background of the Disclosure

Generally, a laundry treating device includes a washer for washing laundry, a dryer for drying clothes and a laundry machine for performing both washing and drying of clothes. In such a laundry treating apparatus, the washing means a cycle configured to remove contaminants or dirt from laundry by using a chemical action between water and washing detergents and the drying means a cycle configured to remove the water elements or moisture contained in the clothes by using a hot air supply device provided in the laundry treating apparatus.

A conventional laundry treating apparatus includes a cabinet which defines an exterior appearance, with an opening; a laundry accommodation portion provided in the cabinet; a drive portion configured to rotate a drum provided as the laundry accommodation portion; and a door configured to open and close the opening.

The door is one element which occupies quite a space of the cabinet and affects an overall design beauty and unity. The door is rotatably coupled to a front or top of the cabinet to rotate the on the front or top as its axis, only to which attracts a user's intensions intensively.

Using such characteristics of the door, recently a new laundry treating apparatus has been released, which has a control panel provided on the door to receive a user's control command for controlling the laundry accommodation portion to perform a wash or dry cycle.

In addition, the door may have a larger diameter than the opening so as to strengthen the user's access and emphasize the design beauty.

Accordingly, the door may employed to open and close not only the opening but also as the interface configured to allow the user control and recognize the laundry treating apparatus.

However, the control panel has to be insertedly loaded in the door of the conventional laundry treating apparatus mentioned above and other diverse elements have to be coupled to the control panel.

For that, the conventional laundry treating apparatus may include a first frame for opening and closing the opening; and a second frame coupled to the first frame and defining the external design of the door, not one frame fabricated for the door. Hence, the control panel is loaded between the first and second frames.

In this instance, the first frame and the second frame may be coupled to each other by using an adhesive to improve the unity of the external design and beauty, not fastened to each other by using a fastening member such as a bolt or the like.

Meanwhile, the door mentioned above may include a locking portion which is provided to operate a push button when opening and closing the opening. The locking portion may be repeatedly in an opening or closing state where the door is able to open or close the opening, whenever an external force is applied thereto.

The locking portion is able to be deformable by a preset degree or rotatable a preset angle whenever the external force is applied thereto, only to be coupled to or decoupled from a locking portion coupling device provided in an outer circumferential surface of the opening. Accordingly, the user is able to couple or decouple the door to or from the opening easily only if applying an external force to the door.

Even when rotated a preset angle or deformed, the locking portion needs to include a flexible member such as a spring to return to its original position.

Such a flexible member is supported by the first frame and the second frame simultaneously so as to transmit the restoring force to the locking portion even when the locking portion is rotated a preset angle.

However, the conventional laundry treating apparatus having the structure mentioned above might have a disadvantage that the first and second frames pushes each other according to a principal of action and reaction while transmitting the restoring force to the locking portion.

Moreover, the flexible member of the locking portion disadvantageously might push the first frame and the second frame to make the assembling process difficult when the first and second frames are coupled to each other.

In case an external shock is applied to the conventional laundry treating apparatus during the transportation, the locking portion might separate from the door disadvantageously.

SUMMARY OF THE DISCLOSURE

Accordingly, an object of the present disclosure is to address the above-noted and other problems and to provide a laundry treating apparatus of which a locking portion provided in a door to couple or decouple the door to or from an opening, using elasticity, is able to be fixed only one frame.

A further object of the present disclosure is to provide a laundry treating apparatus which may prevent the locking portion from generating an unnecessary external force when assembling the door.

A still further object of the present disclosure is to provide a laundry treating apparatus which may keep the profile of the door even the coupling the door by using only an adhesive;

A still further object of the present disclosure is to provide a laundry treating apparatus which may keep the position of the locking portion even when vibration or a shock is transmitted to the door.

Embodiments of the present disclosure may provide a laundry treating apparatus comprising: a cabinet comprising an opening; a laundry accommodating portion mounted in the cabinet and comprising an opening which is communicable with the opening; a door rotatably coupled to the cabinet and provided to open and close the opening; and a locking portion detachably coupled to the door; a coupling portion provided in the cabinet to be repeatedly coupled to or decoupled from the locking portion whenever an external force is applied to the door, wherein the door comprises a first frame provided to open and close the opening; and a second frame coupled to one surface of the first frame, and the locking portion is provided in the first frame and prevented from contacting with the second frame.

The first frame and the second frame may be coupled to each other by using an adhesive.

The locking portion may comprise a latch rotatable a present angle or restituted through the first frame whenever an external force is applied to the door, to be coupled to or decoupled from the coupling portion; a latch spring provided to restitute the latch even when the latch is rotated a preset angle; and a fixing portion provided in the first frame to secure both ends of the latch spring thereto.

The latch may comprise a latch body which is able to be coupled to or decoupled from the coupling portion; and a pin fixed to the fixing portion through a lower end of the latch body, and the latch spring may comprise a first elastic portion wounded around an outer circumferential surface of the pin from one side of the latch body at least one time; a second elastic portion wounded around the outer circumferential surface of the pin from the other side of the latch body at least one time; a latch supporting portion providing a restitution force to the latch body by contacting with one surface of the latch body and connecting the first and second elastic portions with each other; a first extended portion extended from the first elastic portion to be fixed to the fixing portion; and a second extended portion extended from the second elastic portion to be fixed to the fixing portion.

The fixing portion may comprise a fixing body coupled to the first frame or integrally formed with the first frame as one body; a first fixing projection projected from the fixing body and fixing the first extended portion and one end of the pin thereto; a second fixing projection projected from the fixing body and fixing the second extended portion and the other end of the pin thereto; and a latch-through-hole formed to allow the latch body between the first and second fixing projections to penetrate the fixing body.

Each of the first and second fixing projections may comprise a hollow; and an open surface provided to expose the hollow outside, and the open surfaces may have the same directivity.

The first fixing projection may comprise a first spring fixing projection fixing the first extended portion thereto; a first pin fixing projection provided in one surface of the first spring fixing projection and fixing one end of the pin thereto, and the second fixing projection may comprise a second spring fixing projection fixing the second extended portion thereto; and a second pin fixing projection provided in one surface of the second spring fixing projection and fixing the other end of the pin thereto.

The first spring fixing projection may comprise a first fixing rib projected toward the latch-through-hole and fixing the first extended portion thereto by contacting, and the second spring fixing projection may comprise a second fixing rib projected toward the latch-through-hole and fixing the second extended portion thereto.

Each of the first and second fixing ribs may further comprise a separation preventing unevenness projected toward the fixing body from a lower end and preventing the separation of the first and second extended portions.

The first pin fixing projection may comprise a first cut-away portion cut away toward the latch-through-hole and securely seating one end of the pin thereon, and a second pin fixing projection may comprise a second cut-away portion cut away toward the latch-through-hole and securely seating the other end of the pin thereon.

The widths of the first and second cut-away portions may be corresponding to a diameter of the pin.

The depths of the first and second cut-away portions may be corresponding to the diameter of the pin.

The first pin fixing projection may further comprise a first inner projected portion extended from one surface facing the first cut-away portion to contact with one end of the pin, and the second pin fixing projection may further comprise a second inner projected portion extended from one surface facing the second cut-away portion to contact with the other end of the pin.

The first pin fixing projection may further comprise a first preventing rib projected from one surface facing the first cut-away portion outside, and the second pin fixing projection may further comprise a second preventing rib projected from one surface facing the second cut-away portion outside, and the first preventing rib, the first cut-away portion, the second cut-away portion and the second preventing rib may be provided on a straight line.

The laundry treating apparatus may further comprise a reinforcing portion extended from one surface of each of the first and second fixing ribs, in parallel with each of the first fixing ribs.

Each of the first and second fixing projections may comprise one or more reinforcing ribs provided in an outer circumferential surface to reinforce the strength of each of the first and second fixing projections.

The fixing body may further comprise an installation groove recessed toward the opening, and the first and second fixing projections are provided in an inner circumferential surface of the installation groove.

At least one of the first and second cut-away portions may further comprise a supporting projection provided in an inner circumferential surface and supporting or fixing an outer circumferential surface of the pin.

The fixing portion may further comprise a hole reinforcing portion provided in an outer circumferential surface of the latch-through-hole and formed thicker than the fixing body.

Advantages of the mobile terminal in accordance with the embodiments of the present disclosure will be described as follows. The locking portion which is provided in a door to couple or decouple the door to or from an opening, using elasticity, is able to be fixed only one frame.

Furthermore, the laundry treating apparatus is capable of preventing the locking portion from generating an unnecessary external force when assembling the door.

Still further, the laundry treating apparatus is capable of keeping the profile of the door even the coupling the door by using only an adhesive.

Still further. The laundry treating apparatus is capable of keeping the position of the locking portion even when vibration or a shock is transmitted to the door.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
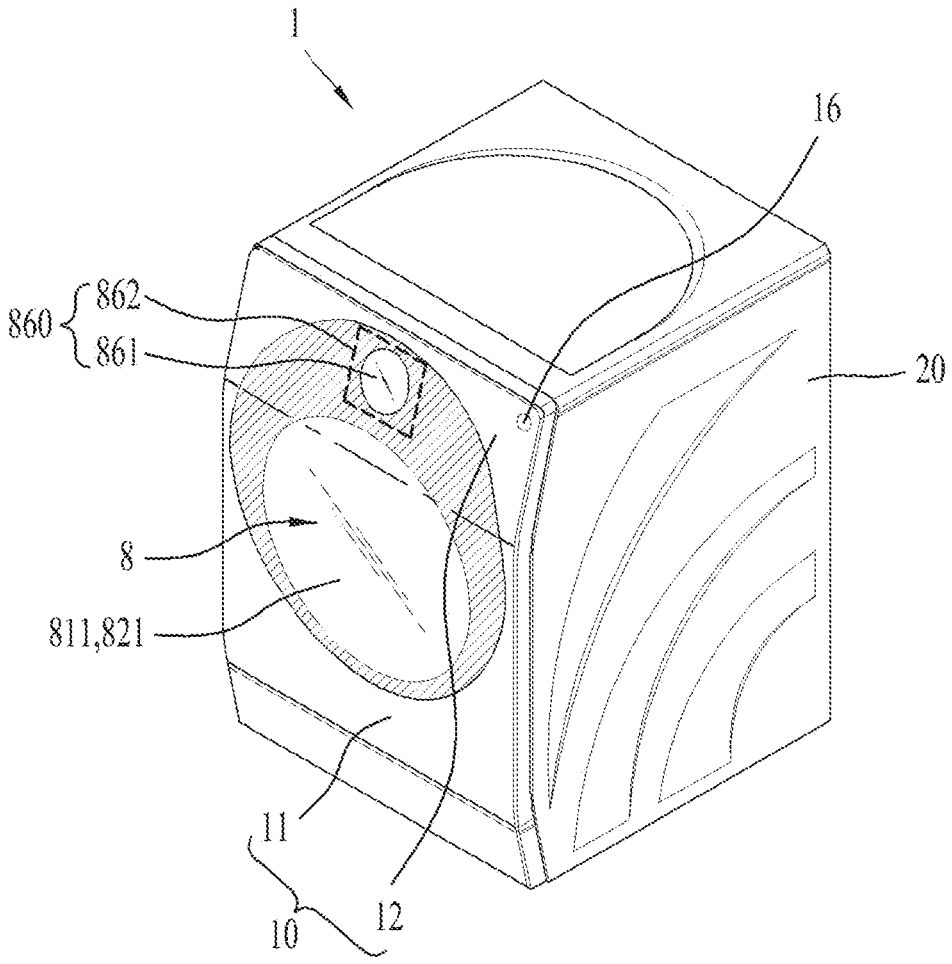
FIG. 1 is a diagram illustrating an external appearance of a laundry treating apparatus in accordance with the present disclosure.
Figure 2:
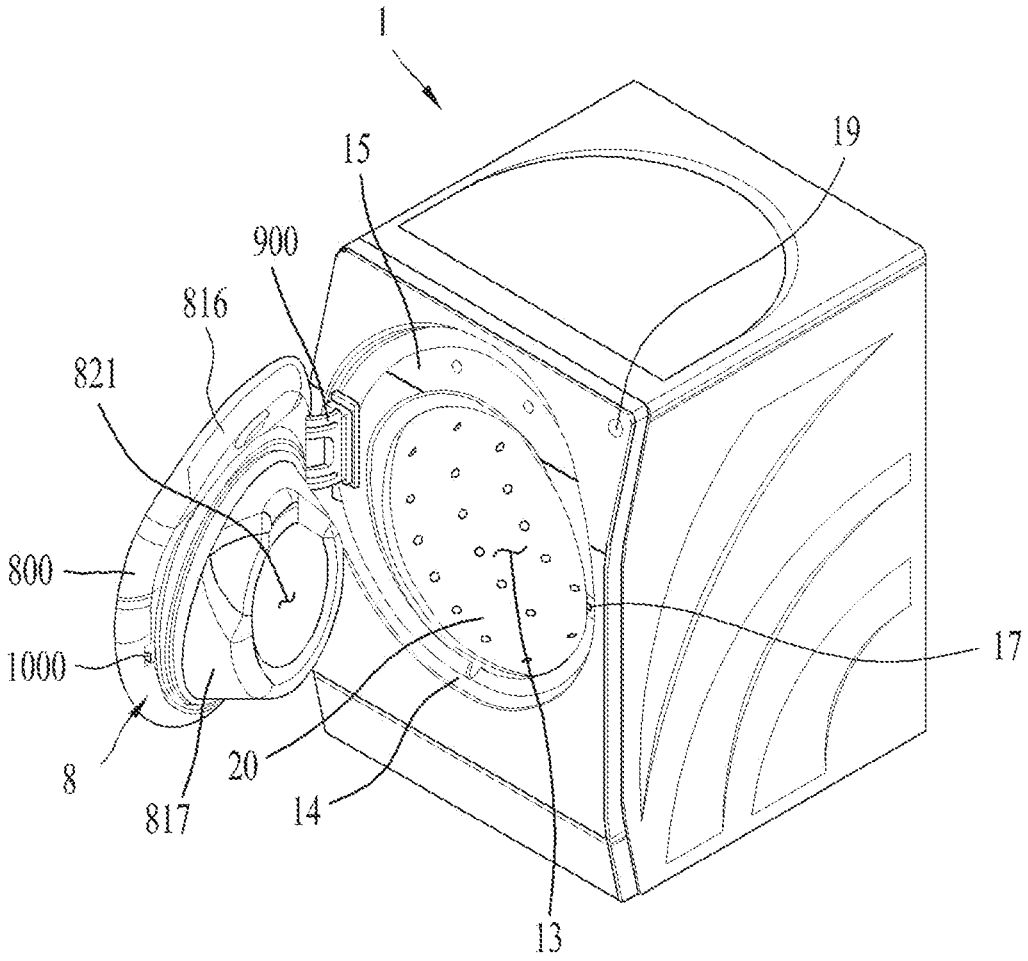
FIG. 2 is a diagram illustrating a state where a door opens an opening.

FIG. 1 is a perspective diagram illustrating a laundry treating apparatus in accordance with one embodiment and FIG. 2 is a conceptual diagram illustrating a state where the door is rotated to open an opening.

The laundry treating apparatus in accordance with one embodiment may include a cabinet 1 having an opening 13; a laundry accommodating portion 20 having an introduction aperture which is communicable with the opening 13; and a door 8 rotatably coupled to the cabinet 1 and configured to open and close the opening 13.

Laundry is introduced into the laundry accommodating portion 20 via the opening 13. The opening 13 may be provided in a front panel 10 of the cabinet or an upper panel arranged in a top of the cabinet 1.

In case the laundry treating apparatus is provided as a washer which is able to perform washing or rinsing for clothes, the laundry accommodating portion 20 may include a tub holding water therein; and a drum rotatably mounted in the tub.

The laundry treating apparatus may include a drive portion (not shown) configured to rotate the drum; a water supply portion (not shown) configured to supply water to the tub; and a drainage portion (not shown) configured to drain the water held in the tub.

In case the laundry treating apparatus is provided as a dryer which is able to perform drying for clothes, the laundry accommodating portion may include a drum rotatably mounted in the cabinet 1.

Even in any cases, the clothes or water accommodated by the laundry accommodating portion 20 have to be prevented from escaping via the opening 13. To prevent that, the door 8 may be employed even to close and seal the opening 13.

The door 8 may be rotatably coupled to the cabinet 1 so that it may attract the user's attention. The door 8 may be projected from the cabinet 1 forwardly or upwardly so that it may the first element the user have easy access to.

In addition, the door 8 is the place the user has to hold when trying to load or unload the laundry via the opening 13 and it has a high possibility of contact with the user.

Accordingly, it may be preferred that a control panel 860 configured to receive an input operation or control command implemented to perform at least one of the wash and dry cycles may be provided in the door 8 of the laundry treating apparatus.

The control panel 860 may include a display panel 861 configured to display a current state of the laundry accommodating portion 20; and a control panel 862 configured to control the display panel 861.

The display panel 861 may display the information which is processed in the laundry treating apparatus. For example, the display panel 861 may display information about execution images of the cycle driven in the laundry treating apparatus and UI (User Interface) and GUI (Graphic User Interface) information corresponding to the execution image information.

Meanwhile, a touch panel or a touch screen may be provided as the display panel 861 to receive an operational command. The display panel 861 may be powered on and off according to a touch input to the display panel 861. At this time, a power button 19 may be omitted in case the power of the laundry treating apparatus may be controlled via the display panel 861.

A printed circuit board (PCB) may be provided as the control panel 862 and configured to control a current state of the laundry accommodating portion 20 to be displayed on the display panel 861 or a signal or a control command input via the display panel 861 to be transmitted to internal components of the cabinet 1.

The control panel 862 may include a communication module for wireless communication such as Wi-Fi to transceive a signal wirelessly.

In addition, the control panel 862 may function as the auxiliary control portion which is configured to control only the display panel 861 and independently provided from a control portion (not shown) configured to control the drive portion, the water supply portion and the drainage portion of the laundry treating apparatus. Even unless supplied to the control portion (not shown), the power may be supplied only to the control panel 860 and the control panel 860 is implemented to control the display panel 861 and the control panel 862. Accordingly, the control panel 862 may serve only the function of the auxiliary control portion implemented to control the internal components provided in the door 8, only to reduce the standby power.

When the opening 13 is provided in the front panel 10, the control panel 860 may be provided on the top of the door 8. When the opening 13 is provided in the upper panel, the control panel 860 may be provided on the front of the door 8.

That is to facilitate the user's easy access to the control panel 860.

Hereinafter, the illustrated embodiments will be described on a basis that the opening 13 is provided in the front of the cabinet 1. They will be applicable to the opening provided in the top of the cabinet 1.

A diameter of the door 8 may be larger than a diameter of the opening 13. Also, the center of the door 7 may be eccentric upwards or forwards with respect to the center of the opening 13.

In this instance, the control panel 860 is provided in the door 8 and the user is able to recognize and approach the control panel 860 easily.

Accordingly, the front panel 10 including the opening 13 needs to accommodate the door 8 which is larger than the opening 13. For that, the front panel 10 may include a stepped surface 14 for accommodating an outer circumferential surface of the door 8; an accommodating surface 15 extended from the stepped surface 14 to the opening 13 to contact with a rear surface of the door 8.

The stepped surface 14 is bent inwards from the front panel 10 to accommodate the door 8, together with the accommodating surface 15. Accordingly, the door 8 may be partially exposed outside from the front panel 10 and has the larger diameter to expose the control panel 860 to the user easily.

The front panel 10 may include a flat portion 11 having the opening 13; and an inclined portion 12 extended from a top of the flat portion 11 and inclined upwards. A lower end of the inclined portion 12 may partially define the opening 13.

The flat portion 11 may be provided perpendicular to the ground and the inclined portion 12 may be inclined toward the rear surface of the front panel 10, getting closer to an upper end from an upper area.

The door 8 may have an inclination which is provided in an upper area or an upper end, corresponding to the inclined portion 12. In other words, the door 8 may include the inclination which is getting thinner toward the upper area.

As the control panel 860 is provided in the upper area of the door 8, the control panel 860 may be arranged upwards so as to improve the user's accessibility and the user who is taller than the cabinet 1 is able to recognize the control panel 860 easily.

Meanwhile, the door 8 may include a transparent hole 811 and 821 which allows the user to see through the opening 13. The transparent hole 811 and 821 may be provided under the control panel 860 and has a corresponding diameter to the opening 13.

The transparent hole 811 and 821 may be made of a transparent material to make the inside of the laundry accommodating portion 20 visible or exposed outside the cabinet 1.

A gasket 817 for sealing the opening 13 may be provided in the rear surface of the door 8. The gasket 817 has one surface which is inserted in the opening 13 by a preset length and it may prevent the laundry held in the laundry accommodating portion 20 from moving toward the door 8 and water or moisture from coming into a gap between the cabinet 1 and the laundry accommodating portion 20.

It is preferred that the gasket 817 is made of a transparent material.

Meanwhile, the laundry treating apparatus may include a hinge portion 900 provided to rotatably couple the door 8 to the cabinet 1; and a locking portion 1000 provided to lock the door 8 to the cabinet 1 and configured to prevent the opening 13 from opening arbitrarily.

The hinge portion 900 may be provided in any shapes, only when coupled to an outer circumferential surface of the opening 13 and the door 8 to facilitate the rotation of the door 8 while opening the opening 13.

The hinge portion 900 may include a power supply part provide in the cabinet; and a harness connecting part (not shown) configured to transmit a signal of a main control portion for controlling the laundry accommodating portion to the control panel 860 provided in the door 8.

The locking portion 1000 may be provided in the door 8 and coupled or decoupled to or from the cabinet 1.

The locking portion 1000 may be provided in an area which is opposite to the hinge portion 900, because the area is the point where a rotation moment of the door 8 is the largest.

The locking portion 1000 may repeat an open state where the opening 13 is open by the door 8 and a closed state where the opening 13 is closed by the door 8, whenever an external force is applied to the door toward the opening 13.

For that, a predetermined area of the locking portion 1000 may penetrate the door 8 and the cabinet 1 may include a coupling portion 17 provided in the outer circumferential surface of the opening 13 and able to be coupled or decoupled to or from the locking portion 1000.

The door 8 has to accommodate the control panel 860. It is preferred that the door 8 is formed of the two frames coupled to each other, rather than one fabricated body.

Figure 3A:
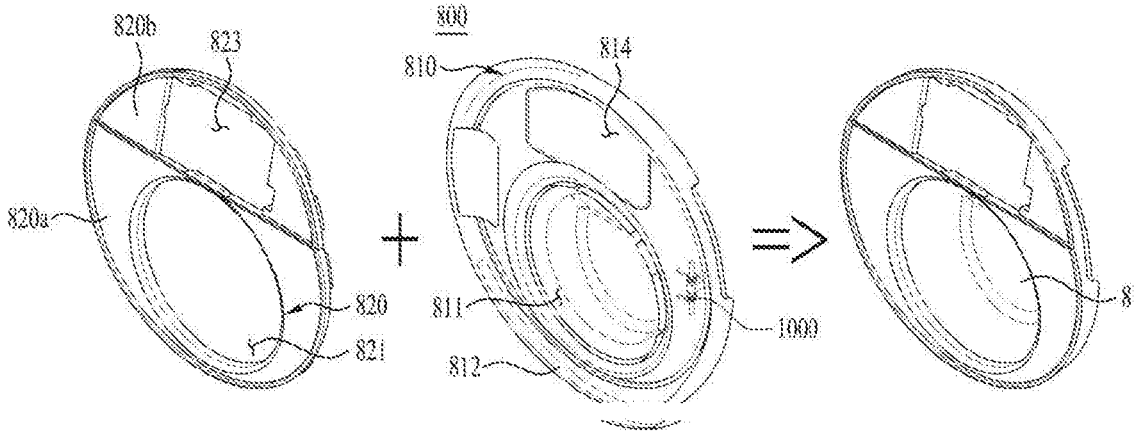
FIGS. 3A and 3B are diagrams illustrating an assembly structure of the door.
Figure 3B:
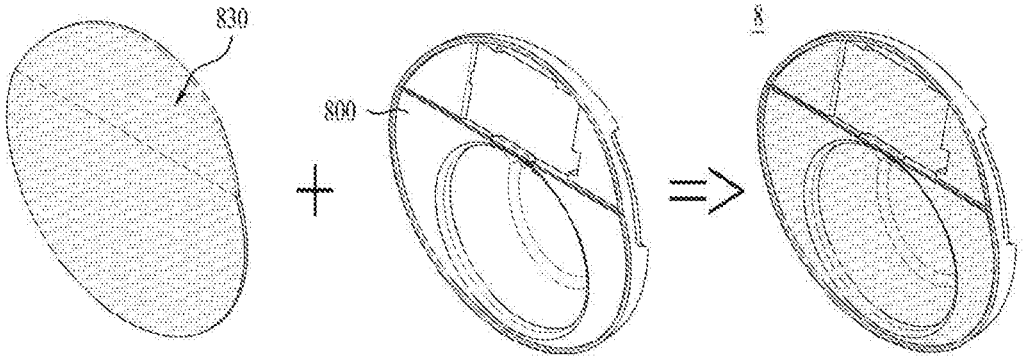

FIG. 3A illustrates the configuration of the frames which defines the profile of the door 8 and the coupling of the frames. FIG. 3B illustrates the configuration and coupling of the frame and a door cover.

The door 8 may include a first frame 810 for opening and closing the opening 13; a second frame 820 coupled to a front of the first frame 810; and a door cover 830 coupled to a front of the second frame 820 to define a front surface of the door 8.

The reason why the door 8 is formed of the frames, not one body, is to form a predetermined space in the door 8 in which the control panel 860, the hinge portion 900 and the locking portion 1000 are installed.

The first frame 810 and the second frame 820 may define the profile or external design of the door 8, more specifically, a front surface and a rear surface of the door 8, respectively.

The first frame 810 may include a first transparent hole 811 provided to make the user see through the internal space of the laundry accommodating portion 20 and penetrating the first frame 810; a panel introduction hole 814 to allow the control panel 860 introduced there through; and a panel cover 816 provided to open and close the panel introduction hole 814 and arranged in parallel with a rear surface of the first frame 810.

The gasket 817 may be provided in an inner circumferential surface of the first transparent hole 811 to seal the opening 13.

The second frame 820 may include a second transparent hole 821 arranged through the second frame 820, corresponding to the first transparent hole 811; and a panel display hole 823 provided to expose the control panel 860 outside.

As mentioned above, one side or upper area of the front panel 10 may be inclined. When the front panel 10 includes the inclined portion 12, an upper area of the second frame 820 may have a corresponding inclination to the inclined portion 12.

More specifically, the upper area of the second frame 820 may be inclined toward the first frame 810. The second frame 820 may include a frame body 820*a* arranged in parallel with the first frame 810; and a body inclined portion 820*b* provided in a top of the frame body and inclined toward the first frame 810.

The first frame 810 and the second frame 820 are coupled to each other to define the external design or profile of the door 8. The first frame 810 and the second frame 820 may be fastened to each other by using a fastening member such as a bolt. However, when using the fastening member, through-holes have to be provided in the first frame 810 and the second frame 820, respectively. The trough-holes are likely to cause a weld line when injection-molding the first and second frames 810 and 820. Also, it is necessary to secure the space in which the fastening member is installed.

To solve those disadvantages, the first frame 810 and the second frame 820 may be coupled to each other by using an adhesive.

The adhesive is applied to the first and second frames 810 and 820 and the frames are bonded to each other. Accordingly, the auxiliary fastening member may be omitted and the unity or beauty of the external design may be improved.

The door cover 830 may be attached to the exposed surface of the second frame 820 and made of a transparent material. Alternatively, the door cover 830 may have an area which is made of a transparent material, corresponding to the panel display hole 823 and the second transparent hole 821, and the other area made of a non-transparent material to block the other internal components so as to enhance the external beauty.

Meanwhile, the locking portion 1000 may be installed between the first frame 810 and the second frame 820, before the frames are coupled to each other.

More specifically, after the locking portion 1000 is loaded between the first and second frames 810 and 820, the first and second frames 810 and 820 are coupled to each other and the locking portion 1000 is then fixed in the door 8.

Figure 4A:
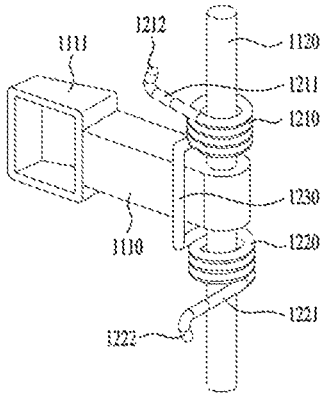
FIGS. 4A to 4C are diagrams illustrating a structure of a stop portion.
Figure 4B:
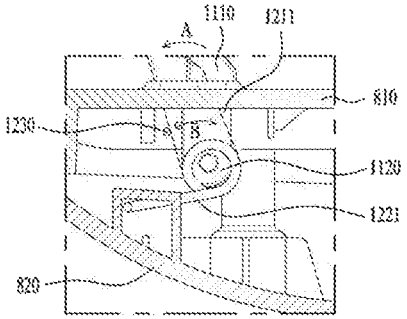
Figure 4C:
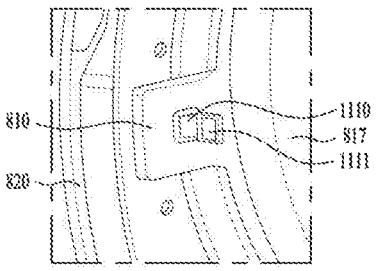

FIGS. 4A to 4C illustrate one embodiment of the locking portion 1000.

FIG. 4A illustrates the structure of the locking portion 1000. FIG. 4B illustrates that the locking portion 1000 is provided in the door 8 and FIG. 4C illustrates that the locking portion 1000 is projected through the first frame 810.

The locking portion 1000 may include a latch 1100 which is rotatable a preset angle and restitutes via the first frame 810 to be locked to or released from the coupling portion 17, whenever the external force is applied to the door 8; and a latch spring 1200 for restituting the latch 1100 rotated the preset angle.

The latch 1100 may include a latch body 1110 provided in a bar shape; a head-through-hole 1111 provided in one end of the latch body 1110; and a pin 1120 penetrating a lower end of the latch body 1110.

The head-through-hole 1111 may have a larger diameter or thickness than the latch body 1110.

The coupling portion 17 may be a projection which is able to be lockingly inserted in the head-through-hole 1111 (see FIG. 2).

While the latch body 1110 is rotatable a preset angle in every case the external force is applied to the door 8 and restituted by the latch spring 1200, the head-through-hole 1111 is insertedly fixed to the coupling portion 17 or released from the coupling portion 17.

The external force applied to the door 8 may be directed toward the opening 13.

When water or laundry pushes the door 8 in the laundry accommodating portion 20, the latch 1110 has to be prevented from becoming separated from the coupling portion 17.

More specifically, the door 8 may repeat the opening and closing of the opening 13 only when an external force is applied thereto toward the opening 13.

In other words, the locking portion 1000 may serve as a push button.

The latch spring 1200 may include a first elastic portion 1210 wounded around an outer circumferential surface of the pin from one side of the latch body 1110 at least one time; a second elastic portion 1220 wounded the outer circumferential surface of the pin from the other side of the latch body; a latch supporting portion 1230 providing a restoring force to the latch body by contacting with the one surface of the latch body and connecting the first and second elastic portions with each other; a first extended portion 1211 extended from the first elastic portion 1210 and supported by one of the first and second frames 810 and 820; and a second extended portion 1221 extended from the second elastic portion 1220 and supported by the other one of the frames.

The latch supporting area 1230 may contact with one surface of the latch body 1110 which is provided in parallel with the pin 1120.

The first extended portion 1211 and the second extended portion 1221 may be fixedly supported by the first and second frames 810 and 820. When the latch body 1110 pushes the latch supporting portion 1230 after rotated toward the latch supporting portion 1230, the latch supporting portion 1230 may restitute the latch body 1110 by the elasticity of the first and second elastic portions 1210 and 1220.

The directivity of the first extended portion 1211 may be different from that of the second extended portion 1221, so that the first and second extended portions 1211 and 1221 can be supported by the different frames, respectively.

Meanwhile, a first bent portion 1212 and a second bent portion 1222 may be provided in a lower end of the first extended portion 1211 and a lower end of the second extended portion 1222, respectively.

The first and second bent portions 1212 and 1222 may be functioned to maximize the effect of the supporting between the first and second extended portions 1211 and 1221 to the first and second frames and the fixing with respect to fixing means.

Referring to FIG. 4B, the first extended portion 1211 may be fixed to the first frame 810 and the second extended portion 1221 to the second frame 820.

At this time, when the latch body 1110 is rotated in A direction by the external force, the first and second extended portions 1211 and 1311 are fixed to the first and second frames 810 and 820, respectively, and the latch supporting portion 1230 is able to apply the restituting force in B direction by the elasticity of the first and second elastic portions 1210 and 1220.

Hence, when the external force to the latch body 1110 is removed, the latch body 1120 is able to be rotated in the B direction by the latch supporting portion 1230 and restitute to its original position.

The latch 1100 may be repeatedly coupled to or decoupled from the coupling portion 17 by the latch spring 1200.

Referring to FIG. 4C, a predetermined area of the latch body 1110 and the head-through-hole 1111 are exposed toward the opening 13 from the first frame 810 and rotated to be coupled to or decoupled from the coupling portion 17.

Meanwhile, as shown in FIG. 4B, when rotated or restituted, the latch body 1110 generates a force which is strong enough to make the first and second frames 810 and 820 become spaced apart from each other based on the principle of action and reaction.

The force generated by the latch spring 1200 might widen or separate at least preset areas of the first and second frames 810 and 820 from each other. While the first and second frames 810 and 820 are coupled by using the adhesive, the latch spring 1200 is likely to push or rotate the first and second frames 810 and 820 by a preset length or angle.

Because of that, mal-assembling might occur during the bonding process of the door frame and a gap might occur between the first and second frames 810 and 820 only to allow water or moisture to permeate to the control panel 860.

Moreover, if the latch spring 1200 is moved from its original position by the shock or vibration transmitted to the door 8, the locking portion 1000 might fail to operate smoothly.

Figure 5:
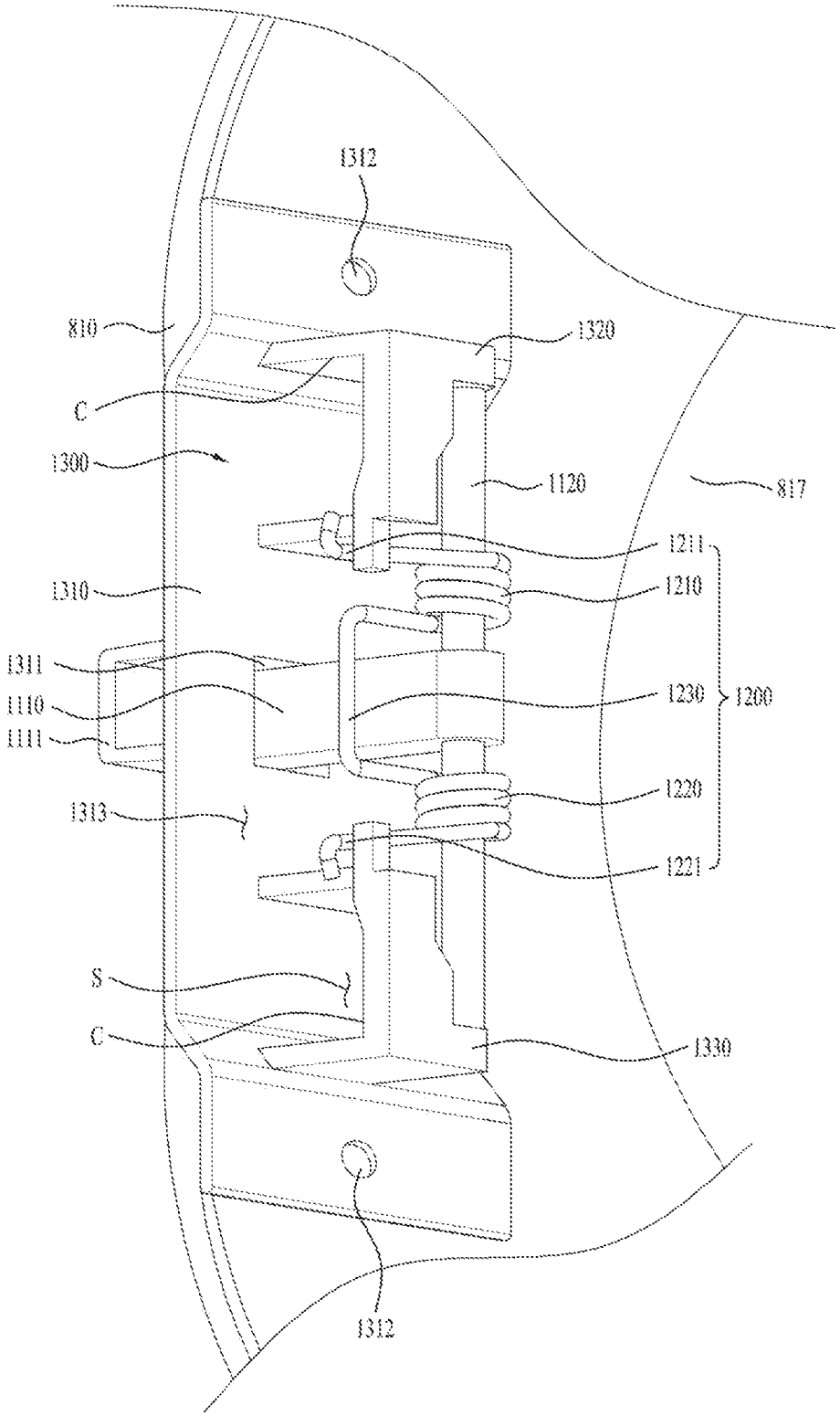
FIG. 5 is another embodiment of the stop portion.

FIG. 5 illustrates another embodiment of the locking portion 1000 provided in the laundry treating apparatus which may solve the noted problems. Hereinafter, different technical features will be described in detail, compared with the embodiment mentioned above, and the configurations not mentioned are equal to those of the embodiment mentioned above.

The locking portion 1000 may be provided in only one of the first and second frames 810 and 820. The locking portion 1000 may be prevented from contacting with the other one of the two frames 810 and 820.

The locking portion 1000 may be is coupled to the coupling portion 17 located in the outer area of the first frame 810 and it is preferred that the locking portion 1000 is provided in the first frame 810. The locking portion 1000 may be spaced apart from the second frame 820 to prevent the contact with the second frame 820.

In other words, all of the elements provided in the locking portion 1000 may be provided in the first frame 810 so as to apply no external force to the second frame 820.

Accordingly, the bonded area between the first and second frames 810 and 820 will not be spaced or deformed by the locking portion 1000, while the first and second frames 810 and 820 are coupled to each other by using the adhesive.

The locking portion 1000 will not change the coupling positions of the first and second frames 810 and 820 coupled to each other and facilitate the coupling process of the frames 810 and 820.

Even any external forces are applied to the locking portion 1000, the coupled area between the frames will be separated.

Accordingly, the assembly efficiency and durability of the door 8 can be enhanced remarkably.

Rather than the configuration of the locking portion mentioned above, the locking portion 1000 may further include a fixing portion 1300 provided in the first frame 810 to secure both ends of the latch spring 1200.

In other words, the first and extended portion 1211 and 1221 of the latch spring 1200 may have the same directivity ultimately.

The fixing portion 1300 may include a fixing body 1310 coupled to the first frame 810 or integrally formed with the first frame as one body; a first fixing projection projected from the fixing body 1310 to secure the first extended portion 1211 and one end 1221 of the pin 1120 thereto; a second fixing projection 1330 projected from the fixing body 1310, spaced apart from the first fixing projection 1320, to secure the second extended portion 1211 and the other end 1122 of the pin 1120 thereto; and a latch-through-hole 1311 provided between the first and second fixing projections 1320 and 1330 to allow the latch body 1110 to penetrate the fixing body 1310.

The fixing body 1310 may be injection-molded, together with the first frame 810 simultaneously, or coupled to the rear surface of the first frame 810, independently provided from the first frame 810.

For that, coupling holes 1312 may be provided in both sides of the fixing body 1310, respectively, to couple the fixing body 1310 to the first frame 810.

The fixing body 1310 may further include an installation groove 1313 recessed from the rear or inner surface of the first frame 810 toward the opening 13.

The installation groove 1313 may be provided to make the first frame thinner.

The installation groove 1313 may be provided to secure the installation space for the locking portion 1000 and prevent the locking portion 1000 from contacting with the second frame 820 at the same time.

In addition, the first fixing projection 1320 and the second fixing projection 1330 are provided in an inner circumferential surface of the installation groove 1313 so as to enhance the durability and earthquake-resistance of the locking portion 1000.

The first and second fixing projections 1320 and the 1330 may be provided in symmetry with the latch-through-hole 1311. The first and second fixing projections 1320 and 1330 may secure both ends of the latch spring 1200 so as to prevent the latch spring 1200 from separating or contacting with the second frame 820, even when any external forces are applied to the latch spring 1200. Also, the first and second fixing projections 1320 and 1330 may rotatably secure the ends of the pin 1120 to facilitate the smooth rotation of the latch 1100.

The first and second fixing projections 1320 and 1330 may support the ends of the pin 1120, so as to prevent the pin 1120 from separating from the fixing portion 1300 even when an external shock or vibration is delivered to the pin 1120.

More specifically, the first and second fixing projections 1320 and 1330 are projected from the fixing body 1300 and employed to secure and support the latch 1100 and the latch spring 1200.

The first and second fixing projections 1320 and 1330 may be formed as a column projected in a rectangular parallelepiped shape or a shape which is combined with several parallelepipeds. Each of the first and second fixing projections 1320 and 1330 may have a hollow (S); and an open surface (C) for exposing the hollow outside.

The hollow (S) may be provided to disperse the load of the first and second fixing projections 1320 and 1330 to a surface, so as to enhance the durability of the first and second fixing projections 1320 and 1330.

The first and second fixing projections 1320 and 1330 may be injected in the same mold. Accordingly, the open surfaces (C) of the first and second fixing projections 1320 and 1330 may have the same directivity.

Figure 6:
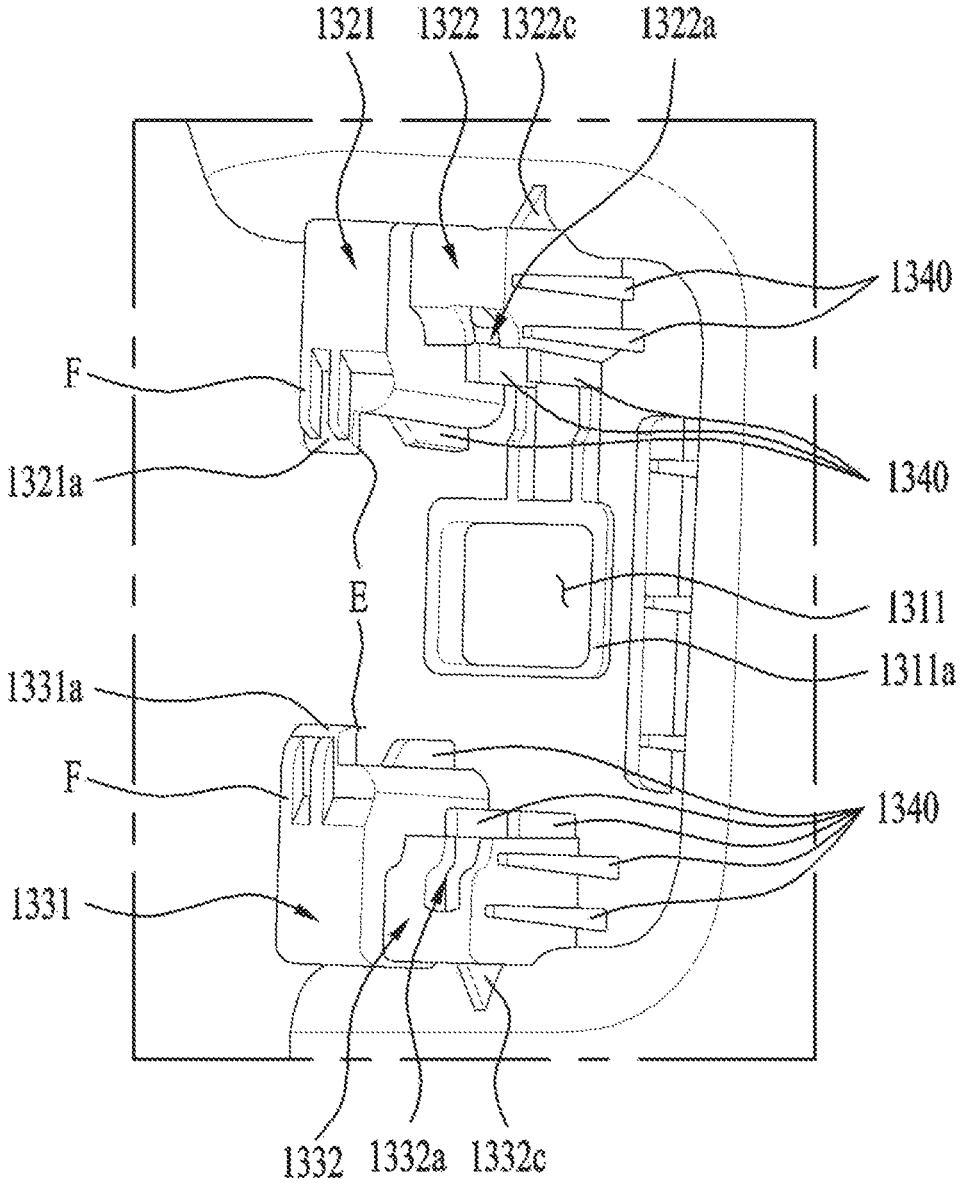
FIG. 6 is a diagram illustrating a structure of a fixing portion.

FIG. 6 illustrates only the fixing portion 1300 of the locking portion 1000.

The first fixing projection 1320 may include a first spring fixing projection 1321 fixing the first extended portion 1211 thereto; and a first pin fixing projection 1322 provided in one surface of the first spring fixing projection and fixing one end of the pin thereto. The second fixing projection 1330 may include a second spring fixing projection fixing the second extended portion 1221 thereto; and a second pin fixing projection provided in one surface of the second spring fixing projection and fixing the other end of the pin thereto.

The first spring fixing projection 1321, the first pin fixing projection 1322 and the second spring fixing projection 1331 and the second pin fixing projection 1332 may be provided to contact with each other. It is more advantageous that they are provided to contact with each other than that they are spaced apart from each other.

The first spring fixing projection 1321 and the second spring fixing projection 1331 may be larger and wider than the first pin fixing projection 1322 and the second pin fixing projection 1332.

That is to stably support and secure the latch spring 1200 which causes the largest load in the locking portion 1300 and secure the pin with a sufficient length.

The first spring fixing projection 1321 may include a first fixing rib 1321*a* projected toward the latch-through-hole 1311 to secure the first extended portion 1211 thereto, in contact. The second spring fixing projection 1331 may include a second fixing rib 1331*a* projected toward the latch-through-hole 1311 to secure the second extended portion 1221 thereto.

That is to secure the first and second extended portions of the latch spring 1200, because they are not provided in parallel with the pin 1120.

The latch supporting portion 1230 has the elasticity which generates the upward rotation with respect to the first and second fixing ribs 1321*a* and 1331*a*, so that the first and second extended portions 1211 and 1221 can be fixed and supported to lower areas of the first and second fixing ribs 1321*a* and 1331*a*.

Meanwhile, a reinforcing portion (F) may be further provided in one surface of each of the first and second fixing ribs 1321*a* and 1331*a*. The reinforcing portion (F) may be extended in parallel with the first and second fixing ribs.

The first and second fixing ribs 1321*a* and 1331*a* are extended from upper surfaces of the spring fixing projections 1321 and 1322 or areas near the upper surfaces, so that durability should be strengthened.

Each of the first and second fixing projections 1320 and 1330 may include at least one reinforcing rib 1340 provided in an outer circumferential surface to reinforce the strengths of the first and second fixing projections.

In addition, a hole reinforcing portion 1311*a* may be provided in an outer circumferential surface of the latch-through-hole 1311 and the hole reinforcing portion 1311 may be thicker than the other portions of the fixing body 1310.

The latch-through-hole 1311 may contact with or collide with the latch body 1110, when the latch body 1110 is rotated.

Accordingly, the fixing portion 1300 may include the hole reinforcing portion 1311*a* to strengthen the durability of the latch-through-hole 1311 and maintain the shape of the latch-through-hole 1311.

Figure 7:
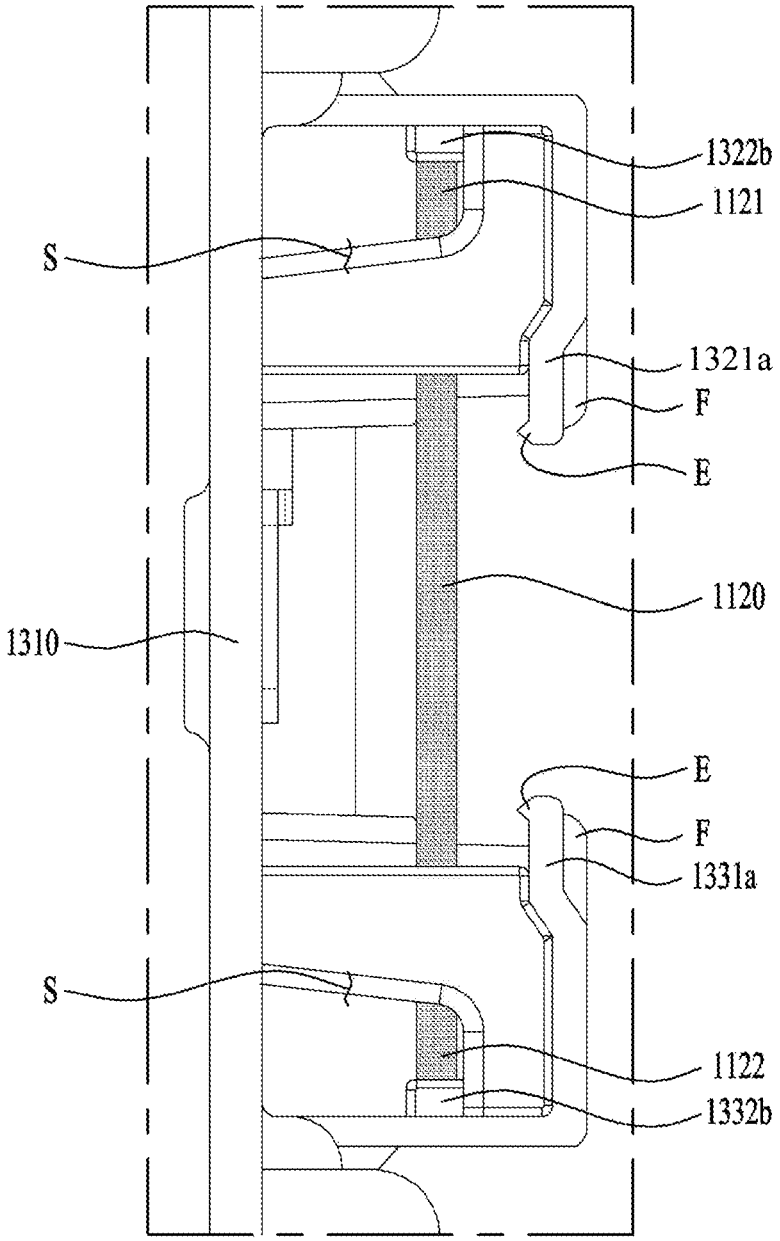
FIG. 7 is a diagram illustrating a state where a pin is installed in the fixing portion.

Meanwhile, each of the first and second fixing ribs 1321*a* and 1331*a* may include a separation preventing unevenness (E) projected from a lower end toward the fixing body 1310 to prevent the separation of each of the first and second extended portions 1211 and 1221 (see FIG. 7).

The separation preventing unevenness (E) may prevent the first and second extended portions 1211 and 1221 from separating from the fixing ribs after getting closer while the latch spring 1200 is deformed by the external force.

Meanwhile, the first pin fixing projection may include a first cut-away portion 1322*a* cut away toward the latch-through-hole to securely seat one end of the pin thereon. The second pin fixing projection may include a second cut-away portion 1332*a* cut away toward the latch-through-hole to seat the other end of the pin thereon.

The first cut-away portion 1322*a* and the second cut-away portion 1332*a* may have the pin 1120 inserted therein. The width of the first and second cut-away portions 1332*a* may be corresponding to the diameter of the pin 1120. The depth of the cut-away portions may be corresponding to the diameter of the pin 1120.

In other words, the first and second cut-away portions 1322*a* and 1332*a* may stably support and secure the pin 1120 by surface-contacting.

Meanwhile, the pin 1120 is seated on one of the first and second cut-away portions 1322*a* and 1332*a* to couple the pin 1120 to the first and second pin fixing projections 1322 and 1332. After that, the pin is seated on the other one of the first and second cut-away portions 1322*a* and 1332*a* to complete the coupling to the first and second pin fixing projections 1322 and 1332.

More specifically, the first and second pin fixing projections 1322 and 1332 have the hollows, respectively, so that some area of the pin 1120 can be inserted in the first and second pin fixing projections 1322 and 1332.

The first and second cut-away portions 1322*a* and 1332*a* are able to support the pin 1120 by using not only the width and depth but also the thickness of the first and second pin fixing projections 1322 and 1332.

Meanwhile, even when the ends of the pin 1120 are securely inserted in the first and second pin fixing projections 1322 and 1332 after the pin 1120 is inserted in the first and second cut-away portions 1322*a* and 1332*a*, the pin 1120 might be moved and released from the first and second cut-away portions 1322*a* and 1332*a* to separate from the first and second pin fixing projections 1322 and 1332 by the vibration of the door 8 or external shocks such as the falling or turnover of the laundry treating apparatus during the transportation.

FIG. 7 is a diagram illustrating that the pin 1120 is fixed to the fixing portion 1300, viewed from the opening (B).

The first pin fixing projection 1322 may further include a first inner projected portion 1322*b* extended from one surface facing the first cut-away portion 1322*a* horizontally to contact with the end 1121 of the pin. The second pin fixing projection 1332 may further include a second inner projected portion 1332*b* projected from one surface facing the second cut-away portion 1332*a* horizontally to face with the other end 1122 of the pin.

A gap between the first and second inner projected portions 1322*a* and 1332*b* may be corresponding to the length of the pin 1120 to secure the ends of the pin 1120. The first and second inner projected portions 1322*a* and 1332*b* may be provided in corresponding areas to the areas where the pin is seated on the cut-away portions, with a larger diameter than the diameter of the pin 1120, to contact with the ends of the pin 1120.\

Accordingly, the pin 1120 may be supported by the first and second pin fixing projections 1322 and 1332 completely not to separate there from by the vibration or shocks.

Meanwhile, the surfaces of the first and second pin fixing projections from which the first and second inner projected portions 1322*a* and 1332*b* are extended might be deformed or distorted by a strong shock applied to the laundry treating apparatus 1 in a moment.

Accordingly, the first pin fixing projection 1322 may further include a first preventing rib 1322*c* projected from one surface facing the first cut-away portion 1322*a* outside. The second pin fixing projection 1332 may further include a second preventing rib 1332*c* projected from one surface facing the second cut-away portion 1332*a* outside.

The first and second preventing ribs 1322*c* and 1332*c* may be provided to prevent the momentary deformation of the pin fixing projections and minimize a deformation degree even in case of the deformation.

At this time, the first preventing rib 1322*c*, the first cut-away portion 1322*a*, the second cut-away portion 1332*a* and the second preventing rib 1332*c* may be provided on a horizontally straight line which is in parallel with the pin 1120.

Accordingly, the pin 1120 may be prevented from separating from the fixing portion 1300.

Figure 8:
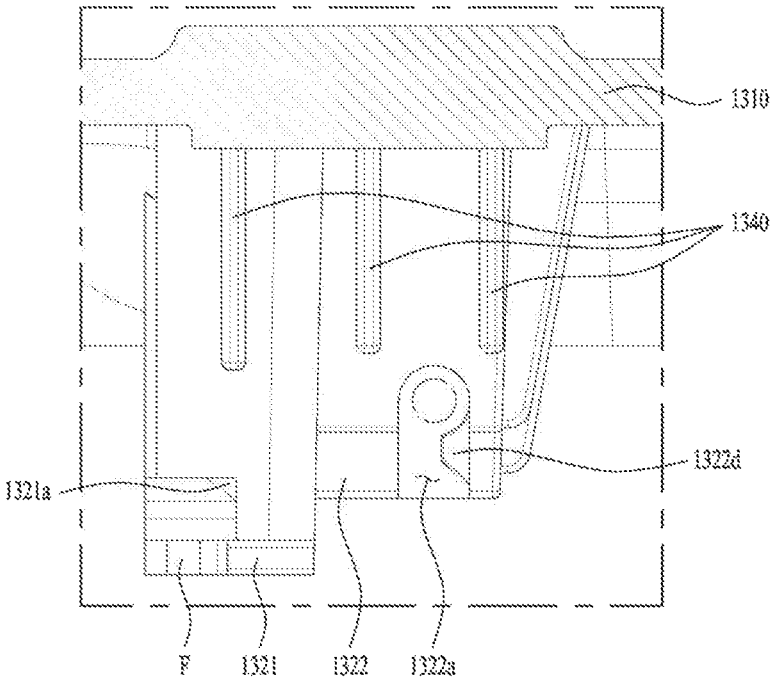
FIG. 8 is a diagram illustrating a configuration of a cut-away portion.

FIG. 8 illustrates the first fixing projection 1320, viewed from the latch-through-hole 1311.

The first cut-away portion 1322*a* may include a supporting projection 1322*d* projected from the inner surface or inner circumferential surface to support or secure the outer circumferential surface of the pin 1120. The supporting projection 1322*d* may be projected from the inner circumferential surface of the cut-away portion 1322*a* and the projected surface may be spaced a preset distance apart from the cut-away portion 1322*a*.

The distance between the projected surface of the supporting projection 1322*d* and the first cut-away portion 1322*a* may be smaller than the diameter of the pin 1120.

When the pin 1120 is forcibly fitted between the supporting projection 1322*d* and the first cut-away portion 1322*a*, the supporting projection 1322*d* may prevent the pin 1120 from separating from the first cut-away portion 1322*a*.

The outer circumferential surface of the supporting projection 1322*d* and the inner circumferential surface of the first-cut-away portion 1322*a* may be corresponding to the diameter of the pin 1120.

Accordingly, the supporting projection 1322*d* may be employed to allow the pin 1120 to be stably rotated, without separating from the cut-away portion 1322*a*.

Even in this instance, the second cut-away portion 1332*a* may be provided in the same shape with the first cut-away portion 1322*a*.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A laundry treating apparatus comprising:

a cabinet that defines an opening;

a laundry accommodating portion that is provided in the cabinet and that defines an introduction aperture configured to communicate with the opening;

a door rotatably coupled to the cabinet and configured to open and close the opening;

a locking portion detachably coupled to the door; and a coupling portion provided in the cabinet and configured to couple to the locking portion, wherein the door comprises:

a first frame configured to open and close the opening, and a second frame coupled to an outer surface of the first frame, wherein the locking portion comprises:

a latch portion configured to, based on external force being applied to the door, rotate by a preset angle or retract through the first frame to thereby couple to or decouple from the coupling portion, a fixing portion disposed at the first frame and configured to support the latch portion, and a latch spring configured to contact the latch portion and to restore a position of the latch portion, the latch spring having a first end and a second end that are coupled to the fixing portion, and wherein the fixing portion comprises:

a fixing body coupled to the first frame or integrally formed with the first frame as one body, a first fixing rib that extends from the fixing body and that contacts and supports the first end of the latch spring, and a second fixing rib that extends from the fixing body and that contacts and supports the second end of the latch spring.

2. The laundry treating apparatus of claim 1, wherein the first frame and the second frame are coupled to each other by using an adhesive.

3. The laundry treating apparatus of claim 1, wherein the latch portion comprises:

a latch body that is configured to couple to and decouple from the coupling portion; and a pin fixed to the fixing portion through a lower end of the latch body, and wherein the latch spring comprises:

a first elastic portion wounded around an outer circumferential surface of the pin from one side of the latch body at least one time;

a second elastic portion wounded around the outer circumferential surface of the pin from the other side of the latch body at least one time;

a latch supporting portion providing a restitution force to the latch body by contacting with one surface of the latch body and connecting the first and second elastic portions with each other;

a first extended portion extended from the first elastic portion to be fixed to the first fixing rib; and a second extended portion extended from the second elastic portion to be fixed to the second fixing rib.

4. The laundry treating apparatus of claim 3, wherein the fixing portion comprises:

a first fixing projection projected from the fixing body and fixing one end of the pin thereto;

a second fixing projection projected from the fixing body and fixing the other end of the pin thereto; and a latch-through-hole formed to allow the latch body between the first fixing projection and second fixing projection to penetrate the fixing body, and wherein the first fixing rib extends from the first fixing projection, and the second fixing rib extends from the second fixing projection.

5. The laundry treating apparatus of claim 4, wherein each of the first fixing projection and second fixing projection comprises:

a hollow; and an open surface provided to expose the hollow outside, and wherein the open surfaces have the same directivity.

6. The laundry treating apparatus of claim 4, wherein the first fixing projection further comprises:

a first pin fixing projection provided in one surface of the first fixing rib and fixing one end of the pin thereto, and wherein the second fixing projection further comprises:

a second pin fixing projection provided in one surface of the second fixing rib and fixing the other end of the pin thereto.

7. The laundry treating apparatus of claim 6, wherein each of the first fixing rib and second fixing rib further comprises:

a separation preventing unevenness projected toward the fixing body from a lower end and preventing the separation of the first extended portion and second extended portion.

8. The laundry treating apparatus of claim 7, further comprising:

a reinforcing portion extended from one surface of each of the first fixing rib and second fixing rib, in parallel with each of the first fixing rib.

9. The laundry treating apparatus of claim 6, wherein the first pin fixing projection comprises:

a first cut-away portion cut away toward the latch-through-hole and securely seating one end of the pin thereon, and wherein the second pin fixing projection comprises a second cut-away portion cut away toward the latch-through-hole and securely seating the other end of the pin thereon.

10. The laundry treating apparatus of claim 9, wherein widths of the first and second cut-away portions correspond to a diameter of the pin.

11. The laundry treating apparatus of claim 10, wherein depths of the first and second cut-away portions correspond to the diameter of the pin.

12. The laundry treating apparatus of claim 11 wherein the first pin fixing projection further comprises:

a first inner projected portion extended from one surface facing the first cut-away portion to contact with one end of the pin, and wherein the second pin fixing projection further comprises a second inner projected portion extended from one surface facing the second cut-away portion to contact with the other end of the pin.

13. The laundry treating apparatus of claim 11 wherein the first pin fixing projection further comprises:

a first preventing rib projected from one surface facing the first cut-away portion outside, wherein the second pin fixing projection further comprises a second preventing rib projected from one surface facing the second cut-away portion outside, and wherein the first preventing rib, the first cut-away portion, the second cut-away portion and the second preventing rib are provided on a straight line.

14. The laundry treating apparatus of claim 9, wherein at least one of the first and second cut-away portions further comprises a supporting projection provided in an inner circumferential surface to support or fix an outer circumferential surface of the pin.

15. The laundry treating apparatus of claim 4, wherein each of the first and second fixing projections comprises one or more reinforcing ribs provided in an outer circumferential surface to reinforce a strength of each of the first fixing projection and second fixing projection.

16. The laundry treating apparatus of claim 4, wherein the fixing body further comprises an installation groove recessed toward the opening, and wherein the first fixing projection and second fixing projection are provided in an inner circumferential surface of the installation groove.

17. The laundry treating apparatus of claim 1, wherein the door further comprises:

a fixing body that is disposed at the first frame, the fixing body defining a latch-through-hole that allows a portion of the locking portion to protrude toward the coupling portion through the first frame; and a hole reinforcing portion that is disposed around an outer circumferential surface of the latch-through-hole, and wherein a thickness of the hole reinforcing portion is greater than a thickness of the fixing body.

18. The laundry treating apparatus of claim 1, wherein the opening is defined at a front surface of the cabinet, and wherein the locking portion comprises a push button that is configured to:

couple to the coupling portion based on the external force being applied to an outer surface of the door toward the front surface of the cabinet; and decouple from the coupling portion based on the external force being applied to the outer surface of the door toward the front surface of the cabinet.

19. The laundry treating apparatus of claim 1, wherein the fixing portion defines a latch-through-hole between the first fixing rib and the second fixing rib, the latch-through-hole being configured to receive the latch portion, and wherein each of the first fixing rib and the second fixing rib extends toward the latch-through-hole.

20. The laundry treating apparatus of claim 1, wherein the fixing body, the first fixing rib, and the second fixing rib are parts of one body formed with the first frame by injection molding.

* * * * *